US009370223B1

(12) United States Patent
Taylor

(10) Patent No.: US 9,370,223 B1
(45) **Date of Patent: *Jun. 21, 2016**

(54) BELT ADJUSTMENT SYSTEM

(71) Applicant: SLIDEBELTS INC., El Dorado Hills, CA (US)

(72) Inventor: Brigham Thomas Taylor, El Dorado Hills, CA (US)

(73) Assignee: SLIDEBELTS INC., El Dorado Hills, CA (US)

( * ) Notice: Subject to any disclaimer, the term of this patent is extended or adjusted under 35 U.S.C. 154(b) by 260 days.

This patent is subject to a terminal disclaimer.

(21) Appl. No.: 14/088,373

(22) Filed: Nov. 23, 2013

Related U.S. Application Data

(63) Continuation of application No. 13/860,439, filed on Apr. 10, 2013, now Pat. No. 9,149,090.

(51) Int. Cl.

| | |
|---|---|
| ***A44B 11/06*** | (2006.01) |
| ***A41F 9/02*** | (2006.01) |
| ***A44B 11/12*** | (2006.01) |
| ***A44B 11/00*** | (2006.01) |

(52) U.S. Cl.
CPC . *A44B 11/12* (2013.01); *A41F 9/02* (2013.01); *A44B 11/006* (2013.01); *A44B 11/065* (2013.01)

(58) Field of Classification Search
CPC .... A44B 11/006; A44B 11/06; A44B 11/001; Y10T 24/3413; Y10T 24/4016; Y10T 24/4037; Y10T 24/404; Y10T 24/4098; Y10T 24/4736; A41F 9/02; A41F 9/025
USPC ..... 24/316, 170, 178, 179, 163 K, 265 BC, 24/68 T, 71 T, 71 ST, 71 SD, 68 F; 2/322
See application file for complete search history.

(56) References Cited

U.S. PATENT DOCUMENTS

| | | | |
|---|---|---|---|
| 2,802,248 | A | 8/1957 | Wallace |
| 3,152,374 | A | 10/1964 | Round |
| 3,466,668 | A | 9/1969 | Ochiai |
| 4,249,267 | A | 2/1981 | Voss |
| 4,669,155 | A | 6/1987 | Chen |
| 5,181,300 | A | 1/1993 | Schwarz |
| 5,572,747 | A | 11/1996 | Cheng |
| 5,579,563 | A | 12/1996 | Sim |
| 5,588,184 | A | 12/1996 | Chen |
| 5,588,186 | A | 12/1996 | Ko |
| 5,806,145 | A | 9/1998 | Chen |
| 5,839,170 | A | 11/1998 | Cho |
| 6,067,662 | A | 5/2000 | Sim |
| 6,081,973 | A | 7/2000 | Liu |
| 6,148,485 | A | 11/2000 | Wu |
| 6,457,210 | B1 | 10/2002 | Shirai et al. |

(Continued)

*Primary Examiner* — Robert J Sandy
(74) *Attorney, Agent, or Firm* — Knobbe, Martens, Olson & Bear, LLP

(57) ABSTRACT

A belt adjustment system includes a belt; a plurality of belt teeth carried by the belt; a belt clamp carried by the belt; a buckle carried by the belt clamp, the buckle accommodating the belt; a lever pivotally carried by the buckle; a tooth-engaging tab carried by the lever, the tooth-engaging tab positional between a tooth-engaging position wherein the tooth-engaging tab engages one of the plurality of belt teeth and a tooth-disengaging position wherein the tooth engaging tab disengages one of the plurality of belt teeth responsive to pivoting of the lever on the buckle; and a tab biasing mechanism normally biasing the tooth-engaging tab in the tooth-engaging position.

16 Claims, 4 Drawing Sheets

(56) References Cited

U.S. PATENT DOCUMENTS

| | | | |
|---|---|---|---|
| 6,898,826 | B2 | 5/2005 | Draper et al. |
| D508,872 | S | 8/2005 | Hoeppner |
| 7,032,415 | B2 | 4/2006 | Young |
| 7,246,383 | B2 | 7/2007 | Musal |
| 7,254,872 | B2 | 8/2007 | Ross |
| D625,656 | S | 10/2010 | Kosh et al. |
| 8,056,192 | B1 | 11/2011 | Posner |
| 8,146,211 | B2 | 4/2012 | Shirai et al. |
| 8,689,364 | B2 | 4/2014 | Rowland et al. |
| 9,149,090 | B1 | 10/2015 | Taylor |
| 2009/0178256 | A1 | 7/2009 | Toth |
| 2012/0036618 | A1 | 2/2012 | Rowland |
| 2013/0167288 | A1 | 7/2013 | Rowland et al. |

BELT ADJUSTMENT SYSTEM

CROSS-REFERENCE TO RELATED APPLICATIONS

This application is a continuation under 35 U.S.C. §120 of U.S. patent application Ser. No. 13/860,439, filed Apr. 10, 2013, now U.S. Pat. No. 9,149,090, entitled BELT ADJUSTMENT SYSTEM, which application is incorporated by reference herein in its entirety.

FIELD OF THE INVENTION

Illustrative embodiments of the disclosure generally relate to buckles for fastening belts. More particularly, illustrative embodiments of the disclosure relate to a dual-lever ratchet buckle and belt adjustment system which facilitates ease and convenience for a user in selectively tightening and fastening a belt around the waist of a user.

BACKGROUND OF THE INVENTION

Conventional belt adjustment systems may utilize a single lever which actuates an adjustment mechanism that interacts with grooved teeth on a belt. The adjustment mechanism allows the belt to be adjusted along a continuum of diameters to accommodate waists of corresponding sizes. However, utilization of a single lever to actuate the adjustment mechanism may be cumbersome for some users. Due to the manner in which the adjustment mechanism interacts with the teeth in the belt, the user may be required to depress the lever of the buckle with extreme force while dislodging the belt from the adjustment mechanism in a back-and-forth motion.

Accordingly, a dual-lever ratchet buckle and belt adjustment system which facilitates ease and convenience for a user in selectively tightening and fastening a belt around the waist of the user may be desirable.

SUMMARY OF THE INVENTION

Illustrative embodiments of the disclosure are generally directed to a belt adjustment system which facilitates ease and convenience for a user in selectively tightening and fastening a belt around the waist of the user. An illustrative embodiment of the belt adjustment system includes a belt; a plurality of belt teeth carried by the belt; a belt clamp carried by the belt; a buckle carried by the belt clamp, the buckle accommodating the belt; a lever pivotally carried by the buckle; a tooth-engaging tab carried by the lever, the tooth-engaging tab positional between a tooth-engaging position wherein the tooth-engaging tab engages one of the plurality of belt teeth and a tooth-disengaging position wherein the tooth engaging tab disengages one of the plurality of belt teeth responsive to pivoting of the lever on the buckle; and a tab biasing mechanism normally biasing the tooth-engaging tab in the tooth-engaging position.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is non-limiting and is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms such as "front" and "rear" as used herein are intended for descriptive purposes only and are not necessarily intended to be construed in a limiting sense.

Figure 8:
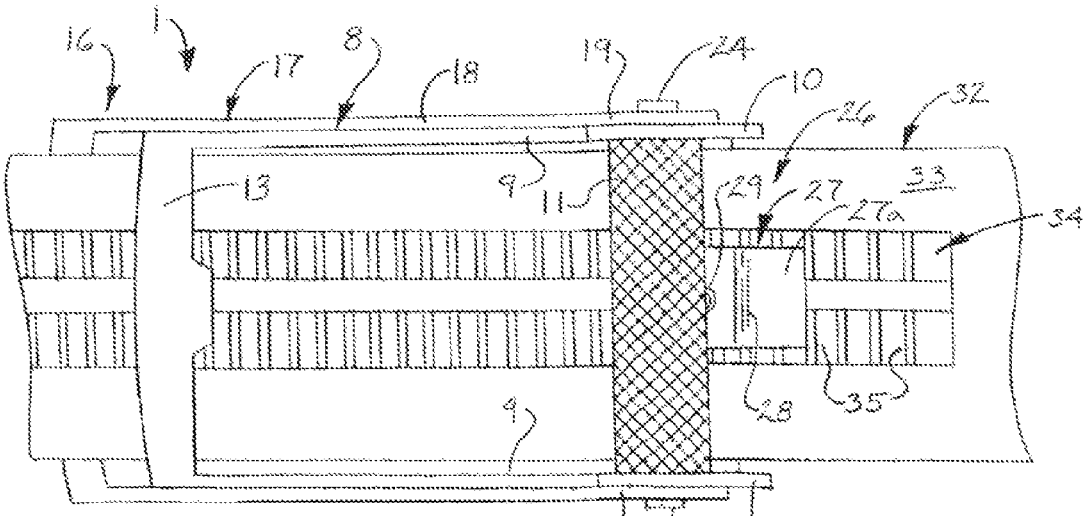
FIG. 8 is a bottom view of an illustrative embodiment of the belt adjustment system provided on a belt.

Referring to the drawings, an illustrative embodiment of the belt adjustment system is generally indicated by reference numeral 1. As will be hereinafter described, the belt adjustment system 1 facilitates ease and convenience for a user (not illustrated) in selective adjustment of a belt 32 around the waist of a user. As illustrated in FIG. 8, the belt 32 may have an inside belt surface 33 which faces the waist of the user. An elongated belt groove 34 extends along at least a portion of the inside belt surface 33. Multiple, spaced-apart belt teeth 35, which may be plastic or other material, are provided in the belt groove 34. The belt adjustment system 1 engages the belt teeth 35 in the belt groove 34 to secure the belt 32 at a selected diameter around the waist of the user, as will be hereinafter further described.

Figure 1:
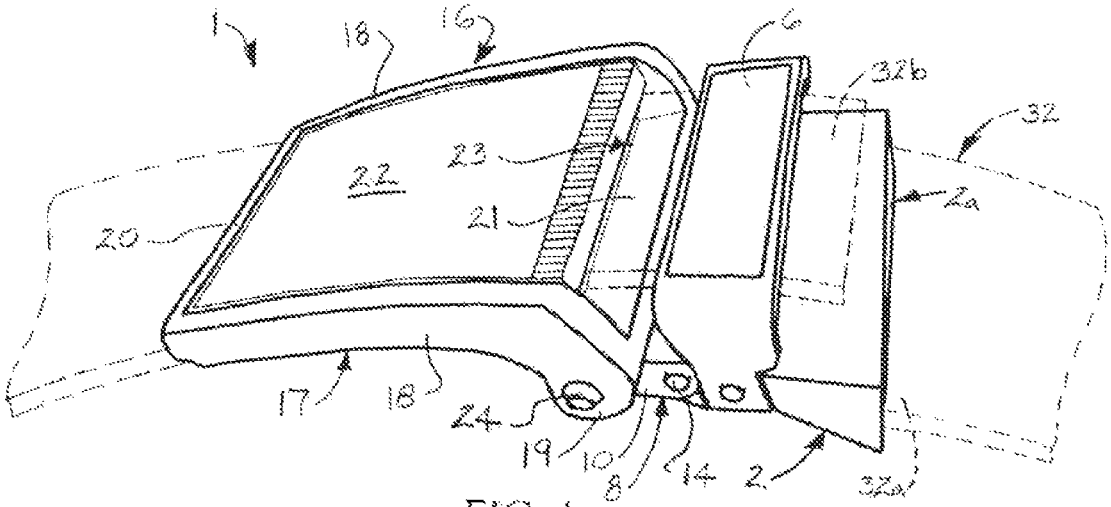
FIG. 1 is a top perspective view of an illustrative embodiment of the belt adjustment system provided on a belt (illustrated in phantom)

As illustrated in FIGS. 1-5, the belt adjustment system 1 includes a belt clamp 2. In some embodiments, the belt clamp 2 may have a belt clamp interior 2*a* (FIG. 1). A tab opening 5 (FIG. 2) in the belt clamp 2 may communicate with the clamp interior 2*a*. A belt tooth tab 3 may be pivotally attached to the belt clamp 2 adjacent to the tab opening 5. Multiple belt teeth 4 may extend from the belt tooth tab 3. The belt tooth tab 3 may be positional between an open, belt-releasing configuration illustrated in FIG. 2, in which the belt tooth tab 3 is unseated from the tab opening 5 and the belt teeth 4 are disposed outside the belt clamp interior 2*a*, and a closed, belt-engaging configuration (FIG. 1) in which the belt tooth tab 3 is seated in the tab opening 5 and the belt teeth 4 extend into the belt clamp interior 2*a*. In use of the belt adjustment system 1, which will be hereinafter described, the belt teeth 4 are adapted to engage and secure an attachment end 32*a* of the belt 32 (illustrated in phantom) which is inserted in the belt clamp interior 2*a* of the belt clamp 2 to attach the belt adjustment system 1 to the belt 32. A belt stay 6 may be attached to the belt clamp 2 to secure a free adjustable end 32*b* of the belt 32, as will be hereinafter described. In other embodiments, the belt clamp 2 may have any design which facilitates attachment of the belt adjustment system 1 to the attachment end 32*a* of the belt 32 according to the knowledge of those skilled in the art.

Figure 2:
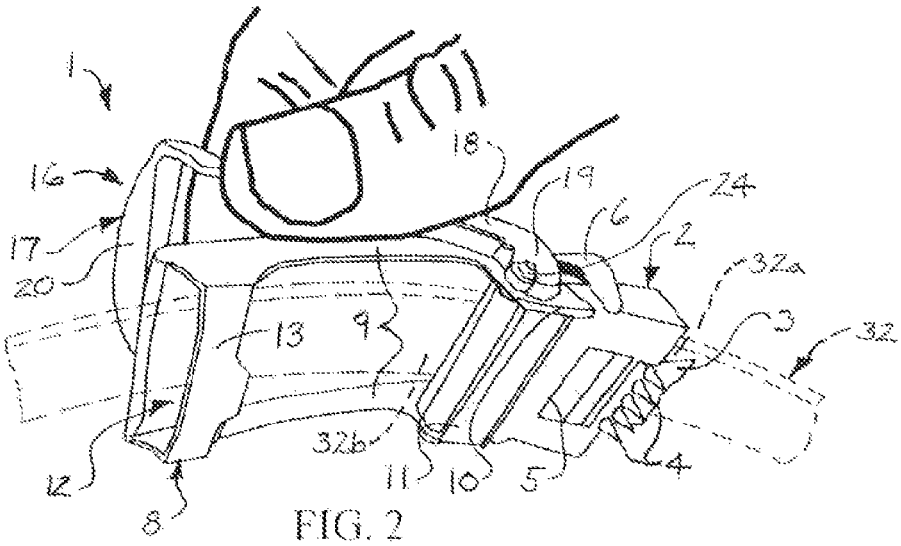
FIG. 2 is a bottom perspective view of an illustrative embodiment of the belt adjustment system provided on a belt (illustrated in phantom)
Figure 4:
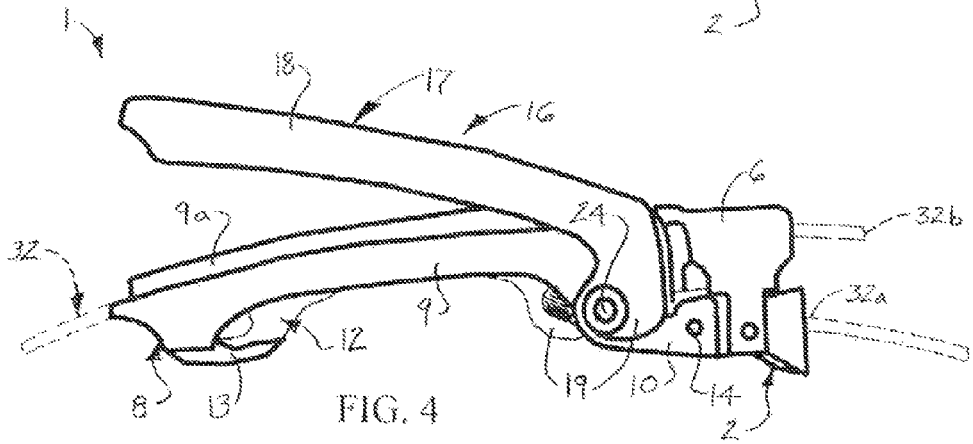
FIG. 4 is a side view of an illustrative embodiment of the belt adjustment system, provided on a belt (illustrated in phantom) and deployed in a belt-releasing configuration.
Figure 5:
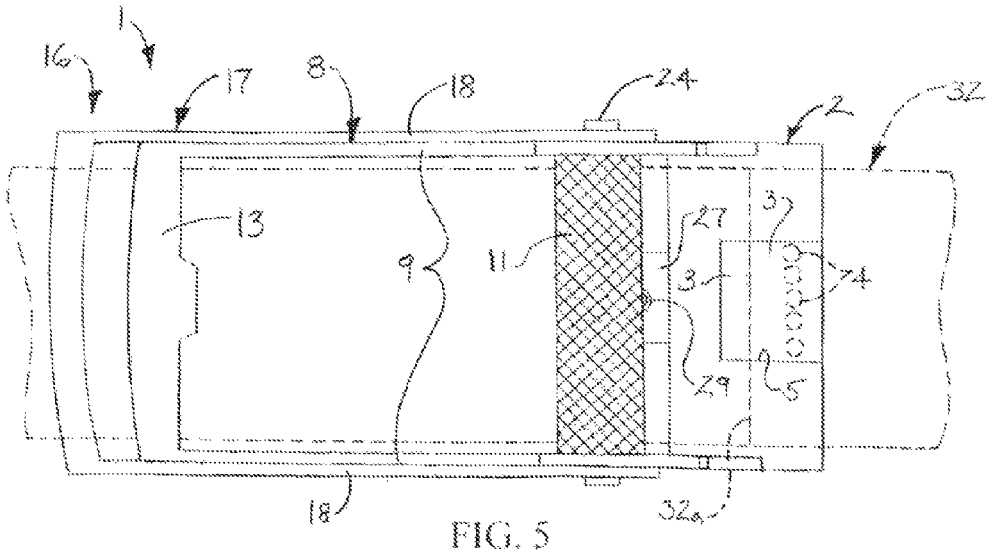
FIG. 5 is a bottom view of an illustrative embodiment of the belt adjustment system, provided on a belt (illustrated in phantom)

A buckle 8 is attached to the belt clamp 2. As illustrated in FIG. 2, the buckle 8 may include a pair of elongated, parallel, spaced-apart side buckle members 9 which terminate in a pair of buckle flanges 10, respectively. The buckle flanges 10 may be attached to opposite sides of the belt clamp 2 such as via a pair of buckle fasteners 14. As further illustrated in FIG. 2, a front connecting member 11 and a rear connecting member 13 may extend between the side buckle members 9 in generally parallel, spaced-apart relationship to each other. The side buckle members 9, the front connecting member 11 and the rear connecting member 13 together form a belt space 12 which accommodates the adjustment end 32*b* of the belt 32. In some embodiments, a pair of lever seat flanges 9*a* (one of which is illustrated in FIG. 4) may extend from the respective side buckle members 9 for purposes which will be hereinafter described.

Figure 9:
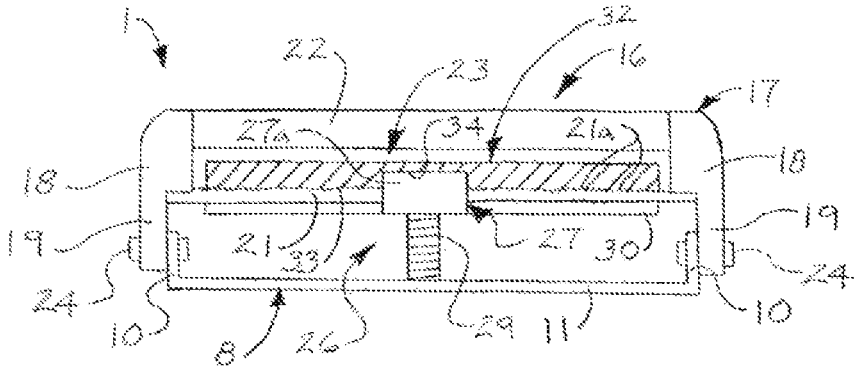
FIG. 9 is a front view, taken along viewing lines 9-9 in FIG. 6, of an illustrative embodiment of the belt adjustment system deployed in the belt-securing configuration.
Figure 10:
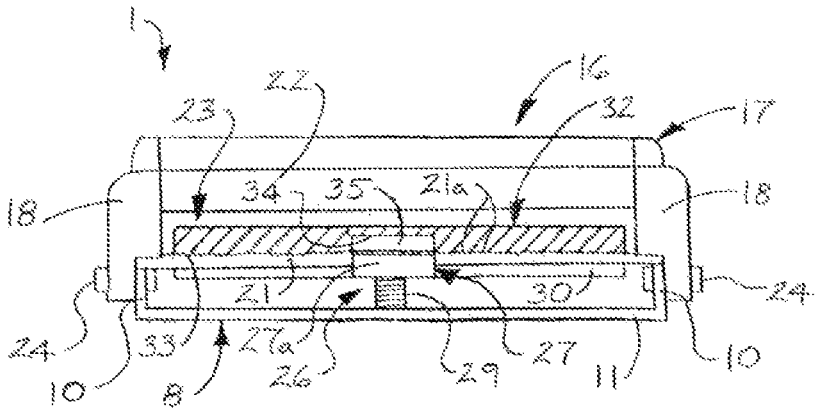
FIG. 10 is a front view, taken along viewing lines 10-10 in FIG. 7, of an illustrative embodiment of the belt adjustment system deployed in the belt-releasing configuration.

A lever 16 is pivotally attached to the buckle 8. As illustrated in FIG. 1, the lever 16 may include a lever frame 17 which may be generally elongated and rectangular. The lever frame 17 may have a pair of generally elongated, parallel, spaced-apart side lever frame members 18 which terminate in a pair of lever frame flanges 19. The lever frame flanges 19 may be pivotally attached to the buckle flanges 10, respectively, of the buckle 8 via pivot pins 24. A connecting frame member 20 may extend between the spaced-apart rear ends of the side lever frame members 18. As illustrated in FIG. 1, a belt engaging member 21 extends between the spaced-apart lever frame flanges 19 on the respective front ends of the side lever frame members 18. Accordingly, as the lever 16 is pivoted between the belt-securing configuration illustrated in FIGS. 3 and 9 and the belt-releasing configuration illustrated in FIGS. 4 and 10, the belt engaging member 21 pivots along with the lever 16. A lever plate 22 may be mounted in the lever frame 17. As illustrated in FIGS. 9 and 10, a belt slot 23 may be formed by and between the side lever frame members 18, the belt-engaging member 21 and the lever plate 22. The belt slot 23 is sized and configured to accommodate the belt 32 in use of the belt adjustment system 1. Multiple serrations 21*a* may be provided on the belt engaging member 21 in facing relationship to the belt slot 23.

Figure 6:
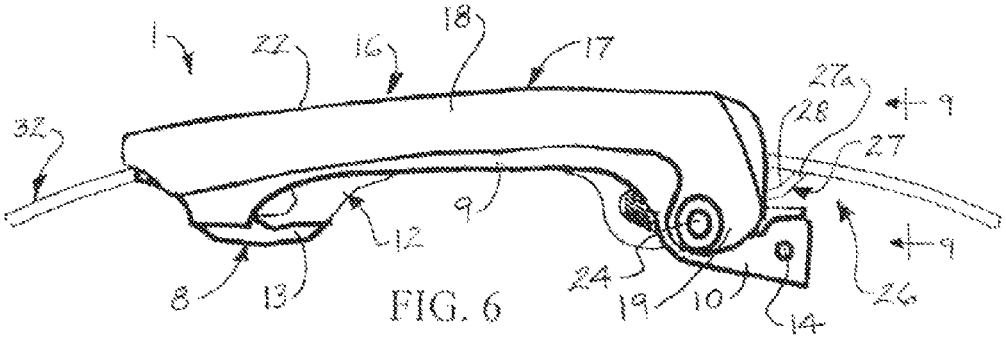
FIG. 6 is a side view of an illustrative embodiment of the belt adjustment system provided on a belt and deployed in the belt-securing configuration, with a belt clamp removed from the belt adjustment system for clarity.
Figure 7:
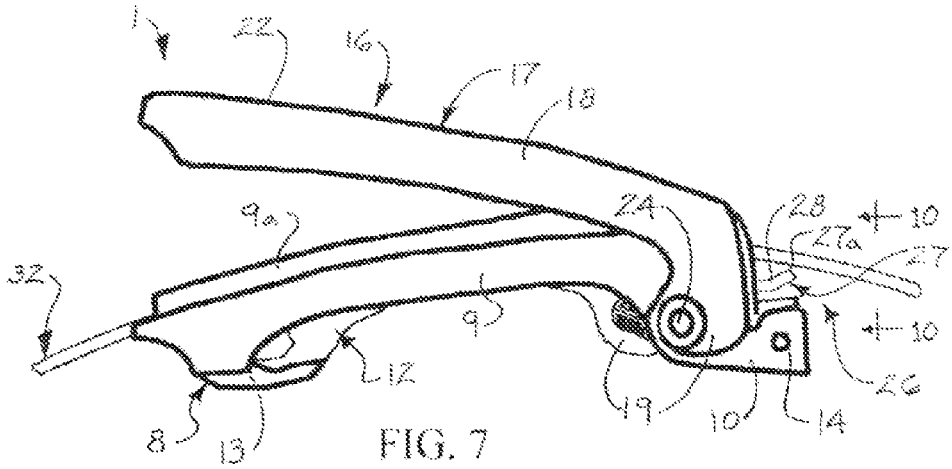
FIG. 7 is a side view of an illustrative embodiment of the belt adjustment system provided on a belt and deployed in the belt-releasing configuration, with the belt clamp removed from the belt adjustment system for clarity.

As further illustrated in FIGS. 9 and 10, a belt engaging assembly 26 may include a tab plate 30 which is provided on the belt engaging member 21. A generally elongated tooth-engaging tab 27 having a distal tab end 27*a* extends from the tab plate 30. As illustrated in FIGS. 6 and 7, the tooth-engaging tab 27 may have a tab bend 28, from which the angled distal tab end 27*a* extends forwardly. When the lever 16 is deployed in the belt-securing configuration illustrated in FIG. 9, the distal tab end 27*a* is disposed adjacent to the belt slot 23 and inserts in the belt groove 34 in the inside belt surface 33 of the belt 32 and engages one of the belt teeth 35, preventing movement of the belt 32 through the belt slot 23 and the belt space 12 of the buckle 8. Conversely, when the lever 16 is deployed in the belt-releasing configuration illustrated in FIG. 10, the distal tab end 27*a* of the tooth-engaging tab 27 clears the belt slot 23 and disengages the belt groove 34 and the belt teeth 35, facilitating free back-and-forth movement of the belt 32 through the belt slot 23 and the belt space 12.

A tab biasing mechanism such as a coiled tab spring 29, for example and without limitation, is sandwiched between the front connecting member 11 of the buckle 8 and the tab plate 30. Accordingly, the tab spring 29 normally biases the tooth-engaging tab 27 in the groove insert position illustrated in FIG. 9 and the lever 16 in the buckle-engaging configuration illustrated in FIGS. 3 and 6. Conversely, the lever 16 can be selectively pivoted against the bias which is imparted by the tab spring 29 to the buckle-disengaging configuration illustrated in FIGS. 4 and 7 such that the tooth-engaging tab 27 disengages the belt groove 34 and the belt teeth 35 in the belt 32. When the lever 16 is deployed in the buckle-engaging configuration, the spaced-apart side lever frame members 18 of the lever frame 17 may be nested on the outsides of the lever seat flanges 9*a*, respectively, on the buckle 8.

In exemplary use of the belt adjustment system 1, the attachment end 32*a* of the belt 32 is inserted in the belt clamp interior 2*a* of the belt clamp 2 with the clamp tooth tab 3 initially disposed in the open configuration illustrated in FIG. 2. The clamp tooth tab 3 is then pivoted to the closed position illustrated in FIG. 5 such that the clamp teeth 4 extend into the belt clamp interior 2*a* and engage and secure the attachment end 32*a* of the belt 32 in the belt clamp 2. The free adjustable end 32*b* and the remaining unsecured portion of the belt 32 may then be inserted through belt loops (not illustrated) in the pants of a user typically in the conventional manner.

Figure 3:
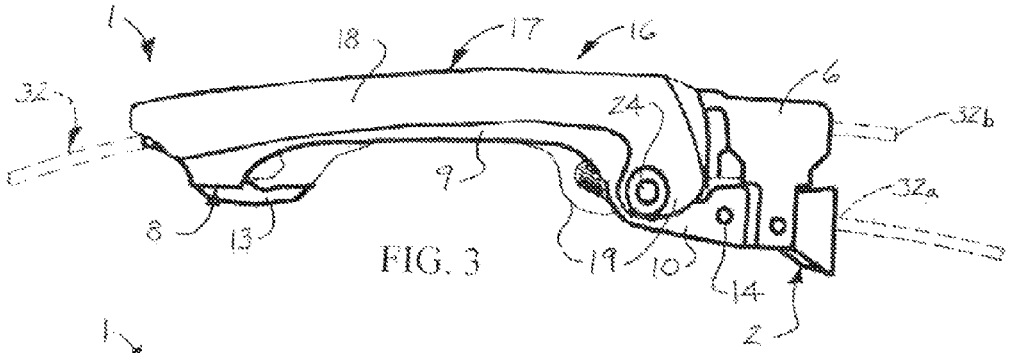
FIG. 3 is a side view of an illustrative embodiment of the belt adjustment system provided on a belt (illustrated in phantom) and deployed in a belt-securing configuration.

The tab spring 29 normally biases the tooth-engaging tab 27 in the tooth-engaging position illustrated in FIG. 9 and the lever 16 in the buckle-engaging position illustrated in FIGS. 3 and 6. Therefore, the lever 16 is manually pivoted to the buckle-disengaging position illustrated in FIGS. 4 and 7 such that the tooth-engaging tab 27 is deployed in the tooth-disengaging position illustrated in FIG. 10 to enable free passage of the belt 32 through the belt slot 23 and the belt space 12 of the belt adjustment system 1. Accordingly, the free adjustable end 32*b* of the belt 32 is inserted through the belt space 12 in the buckle 8 and then through the registering belt slot 23 (FIG. 9) and the belt stay 6, respectively, on the belt clamp 2. The lever 16 is then released such that the tab spring 29 returns the lever 16 to the buckle-engaging position such that the distal tab end 27*a* of the tooth-engaging tab 27 inserts into the belt groove 34 and engages one of the belt teeth 35 (FIG. 8) in the belt groove 34. Therefore, the tooth-engaging tab 27 prevents further movement of the belt 32 through the belt slot 23 and secures the belt 32 at a selected size or diameter around the waist of the user. The user can selectively subsequently pivot the lever 16 against the bias imparted by the tab spring 29 to the buckle-disengaging position to disengage the tooth-engaging tab 27 from the belt teeth 35 and the belt groove 34 and facilitate free movement of the adjustable end 32*b* of the belt 32 through the belt slot 23 until the belt 32 is tightened or loosened according to the preferences of the user. The lever 16 can subsequently again be released such that the tab spring 29 returns the tooth-engaging tab 27 to the tooth-engaging position in the belt groove 34 and the lever 16 to the buckle-engaging position to secure the belt 32 at the selected size or diameter.

It will be appreciated by those skilled in the art that the belt adjustment system 1 allows a user to actuate the lever 16 with one hand to selectively tighten or loosen the belt 32. The belt adjustment system 1 can be selectively removed from the belt 32 by disengaging the clamp teeth 4 on the clamp tooth tab 3 from the attachment end 32*a* of the belt 32, pivoting the lever 16 to the belt-releasing position and sliding the adjustable end 32*b* of the belt 32 from the belt slot 23 (FIGS. 9 and 10) and the belt space 12 (FIG. 2.

While the embodiments of the disclosure have been described above, it will be recognized and understood that various modifications can be made and the appended claims are intended to cover all such modifications which may fall within the spirit and scope of the disclosure.

What is claimed is:

1. A belt adjustment system, comprising:

a belt;

a plurality of belt teeth carried by the belt;

a belt clamp carried by the belt;

a buckle carried by the belt clamp, the buckle accommodating the belt;

a lever having a pair of spaced-apart side lever members pivotally carried by the buckle;

a tooth-engaging tab carried by the lever, the tooth-engaging tab positional between a tooth-engaging position wherein the tooth-engaging tab engages one of the plurality of belt teeth and a tooth-disengaging position wherein the tooth engaging tab disengages one of the plurality of belt teeth responsive to pivoting of the lever on the buckle; and a tab biasing mechanism normally biasing the tooth-engaging tab in the tooth-engaging position.

2. The belt adjustment system of claim 1 wherein the belt clamp comprises a belt clamp interior, a tab opening communicating with the belt clamp interior, a clamp tooth tab pivotally carried by the belt clamp adjacent to the tab opening and at least one clamp tooth carried by the clamp tooth tab.

3. The belt adjustment system of claim 1 wherein the buckle comprises a pair of generally elongated, parallel, spaced-apart side buckle members carried by the belt clamp; spaced-apart first and second connecting members extending between the side buckle members; and a belt space formed by and between the side buckle members and the first and second connecting members, the belt space accommodating the belt.

4. The belt adjustment system of claim 3 wherein the lever comprises a belt slot communicating with the belt space and accommodating the belt.

5. The belt adjustment system of claim 4 wherein the lever comprises a generally elongated rectangular lever frame having a pair of spaced-apart side lever frame members pivotally carried by the buckle, a belt engaging member and a connecting frame member extending between the side lever frame members, a lever plate carried by the lever frame and the belt slot formed by and between the side lever frame members, the belt engaging member and the lever plate.

6. The belt adjustment system of claim 1 wherein the bias mechanism comprises a coiled spring.

7. The belt adjustment system of claim 1 wherein the tooth-engaging tab comprises a tab bend and a distal tab bend angling from the tab bend.

8. The belt adjustment system of claim 1 further comprising a belt stay carried by the belt clamp.

9. A belt adjustment system, comprising:

a belt;

a plurality of belt teeth carried by the belt;

a belt clamp carried by the belt;

a buckle carried by the belt clamp, the buckle accommodating the belt;

a lever pivotally carried by the buckle, the lever selectively positional between a buckle-engaging configuration and a buckle-disengaging configuration;

a tooth-engaging tab carried by the lever, the tooth-engaging tab positional between a tooth-engaging position wherein the tooth-engaging tab engages one of the plurality of belt teeth when the lever is in the buckle-engaging configuration and a tooth-disengaging position wherein the tooth engaging tab disengages one of the plurality of belt teeth when the lever is in the buckle-disengaging configuration; and a tab biasing mechanism sandwiched between the buckle and the lever, the tab biasing mechanism normally biasing the tooth-engaging tab in the tooth-engaging position and the lever in the buckle-engaging configuration.

10. The belt adjustment system of claim 9 wherein the belt clamp comprises a belt clamp interior, a tab opening communicating with the belt clamp interior, a clamp tooth tab pivotally carried by the belt clamp adjacent to the tab opening and at least one clamp tooth carried by the clamp tooth tab.

11. The belt adjustment system of claim 9 wherein the buckle comprises a pair of generally elongated, parallel, spaced-apart side buckle members carried by the belt clamp; spaced-apart first and second connecting members extending between the side buckle members; and a belt space formed by and between the side buckle members and the first and second connecting members, the belt space accommodating the belt.

12. The belt adjustment system of claim 11 wherein the lever comprises a belt slot communicating with the belt space and accommodating the belt.

13. The belt adjustment system of claim 12 wherein the lever comprises a generally elongated rectangular lever frame having a pair of spaced-apart side lever frame members pivotally carried by the buckle, a belt engaging member and a connecting frame member extending between the side lever frame members, a lever plate carried by the lever frame and the belt slot formed by and between the side lever frame members, the belt engaging member and the lever plate.

14. The belt adjustment system of claim 9 wherein the bias mechanism comprises a coiled spring.

15. The belt adjustment system of claim 9 wherein the tooth-engaging tab comprises a tab bend and a distal tab bend angling from the tab bend.

16. The belt adjustment system of claim 9 further comprising a belt stay carried by the belt clamp.

* * * * *